US006820904B1

(12) United States Patent
Goldstein

(10) Patent No.: US 6,820,904 B1
(45) Date of Patent: Nov. 23, 2004

(54) MACHINE THAT TIES AND UNTIES A FOUR-IN-HAND NECKTIE KNOT

(76) Inventor: Seth R. Goldstein, 7103 Laverock La., Bethesda, MD (US) 20817

( * ) Notice: Subject to any disclaimer, the term of this patent is extended or adjusted under 35 U.S.C. 154(b) by 0 days.

(21) Appl. No.: 10/378,501

(22) Filed: Mar. 3, 2003

Related U.S. Application Data

(60) Provisional application No. 60/364,925, filed on Mar. 15, 2002.

(51) Int. Cl.[7] ..... B65H 69/04

(52) U.S. Cl. ..... 289/18.1; 289/1.5

(58) Field of Search ..... 289/1.2, 1.5, 2, 289/4, 17, 18.1; 2/144, 148, 152.1, 153, 154; 223/82, 85, 111, DIG. 1, DIG. 3, DIG. 4; 434/258, 260, 400, 433

(56) References Cited

U.S. PATENT DOCUMENTS 5,562,456 A * 10/1996 Cianciotto ..... 434/260
6,015,172 A * 1/2000 Williams et al. ..... 289/2
6,120,068 A * 9/2000 DiPietro ..... 289/17
6,543,819 B2 * 4/2003 Hakimain ..... 289/2

* cited by examiner

*Primary Examiner*—Gary L. Welch
(74) *Attorney, Agent, or Firm*—Hollander Law Firm, P.L.C.

(57) ABSTRACT

A machine for automatically tying a four-in-hand necktie knot in a necktie, includes (1) a horizontal rotatable cylinder; (2) a hooking mechanism capable of pulling a left hand short segment of the necktie through a loop of a right hand long segment of the necktie hanging from the rotatable cylinder; (3) a finger mechanism capable of laterally moving the right hand long segment along the length of the rotatable cylinder; (4) a whirler mechanism capable of flipping an end of the right hand long segment around the rotatable cylinder and up through a space between the right hand long segment and the left hand short segment and the necktie support, and (5) an electronic and feedback control for operating various mechanisms in response to a sequence of voltage commands.

9 Claims, 13 Drawing Sheets

FIG. 8A
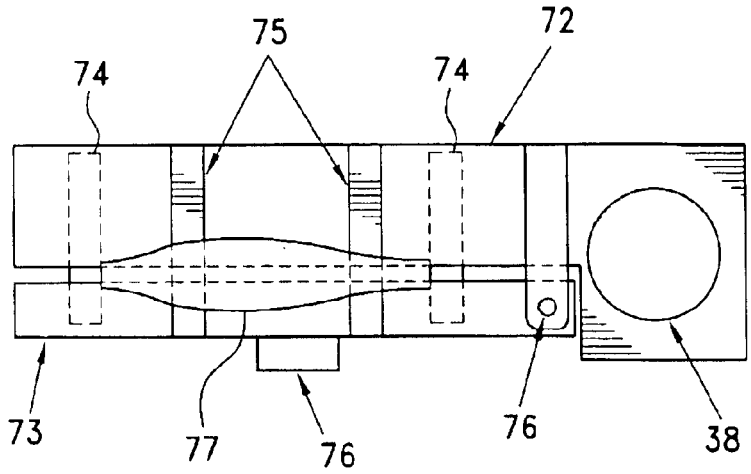
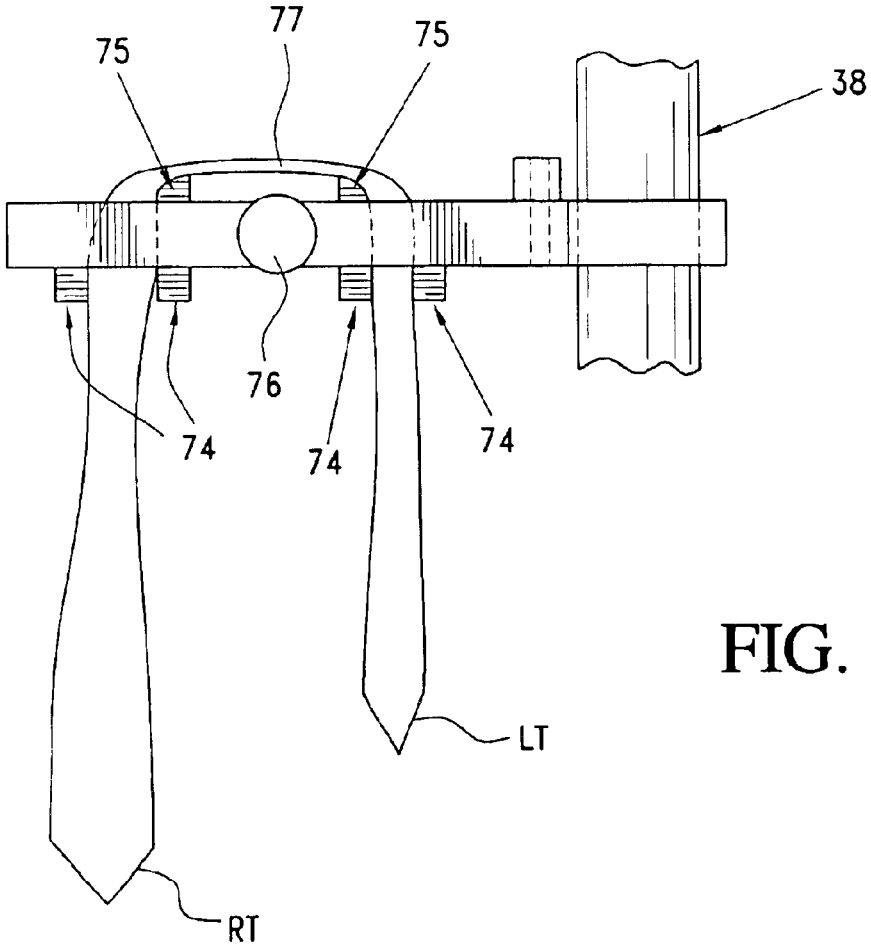
FIG. 8B

MACHINE THAT TIES AND UNTIES A FOUR-IN-HAND NECKTIE KNOT

This application claims the benefit under 35 U.S.C. 119(*e*) of provisional application No. 60/364,925 filed Mar. 15, 2002, in the name of Seth R. Goldstein, the disclosure of which is incorporated by reference in its entirety.

BACKGROUND AND SUMMARY OF INVENTION

I have conceived, built, and successfully operated a machine that ties and then unties a necktie, using a four-in-hand necktie knot. The machine consists of 10 different electric motors that are coordinated by a computer so as to perform the above tasks on a tie hung from a platform located above the motors. The purpose of the machine is for entertainment although in principle, after the tie is tied, it could be removed from the platform and hung on a person's neck as if it had been manually tied.

Each of the ten electric motors has an integral gearhead whose output shaft is attached to a potentiometer that provides feedback to an electronic power operational amplifier that drives the motor resulting in servomechanism operation that is well known to feedback control engineers. Each output shaft has an attached lever or pulley wheel or specially shaped structure to accomplish a given type of task (e.g. pulling or pushing or rolling or grabbing the tie) within the overall cycle. The motors are located on posts several feet high projecting up from a heavy baseplate approximately 1.5×3 feet in size that in turn is mounted upon a wooden base. The input to each of the 10 servomechanisms, which controls how far it is to rotate, is an analog voltage coming from a D/A converter controlled by a personal computer. The computer runs a program that sequentially reads out a data set line by line. The data in each line consists of a first number which selects which motor is to be operated, a second number which determines how far it is to rotate, and a third number which determines how long the computer is to wait before reading out the next line, e.g. typically the duration of the motor motion. In the current version of the data set that successfully ties and unties the necktie, there are approximately 550 lines. It takes approximately 6 minutes to sequentially read out all of these lines, and therefore to tie and untie the necktie.

The most difficult challenge in automatically tying the four-in-hand knot is to push the wider part of the tie (henceforth labeled RT—for right tie) through the space between the first and second wraps of the RT around the narrow part of the tie (henceforth called LT—for left tie). In my design this guidance of the mechanically manipulated RT is facilitated by pulling the RT through a 3 inch diameter horizontally oriented support tube about which rotates an outer rotating tube over which RT has been previously wrapped (the second wrap). The first wrap of RT around LT has previously been manipulated to be outside and behind both concentric tubes so that when the RT is pulled through the support tube, it is automatically located between the first and second wraps. This use of a tube to guide RT as described above dominates the design and operation of the machine. It is explained more thoroughly in Section IV Method of Operation and in the various parts of FIG. 12. The rotary and support tubes can be raised and lowered a distance comparable to the length of the suspended RT. A horizontal tab is attached to the periphery of the rotating tube at its left end. When RT is engaged in the tab and the tube is rotated, RT can be wrapped around the tube by an amount controlled by the tube rotation. In summary, the support tube can be vertically moved to position the outer rotating tube at different heights and the RT ultimately gets pulled through the inner support tube. Hereinafter the term tube assembly is used to stand for the concentric rotary and support tubes.

BRIEF DESCRIPTION OF THE DRAWINGS

FIG. 8A (top view) and FIG. 8B (front view) are schematic diagrams of the tie support assembly.

DETAILED DESCRIPTION OF THE INVENTION

Figure 1A:
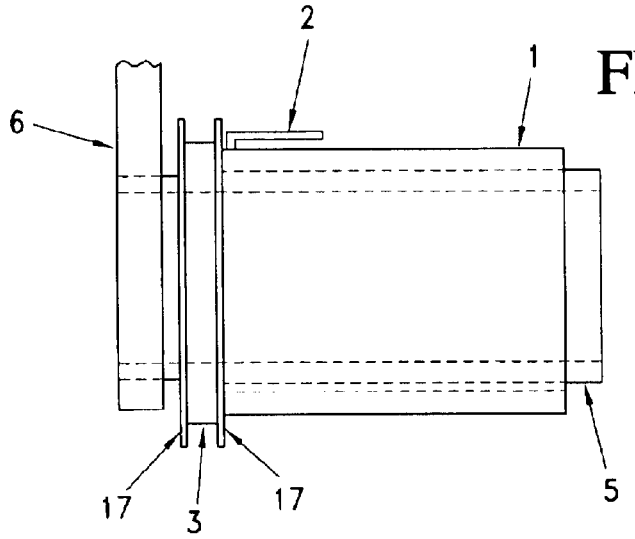
FIG. 1A (front view)
Figure 1B:
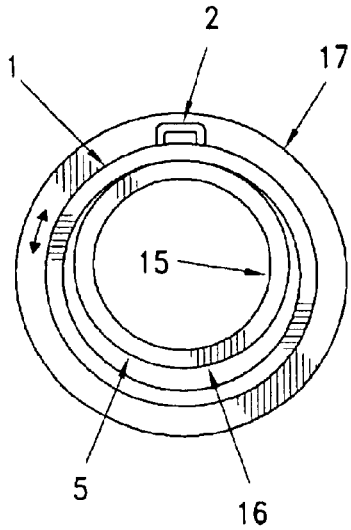
FIG. 1B (right end view)
Figure 1C:
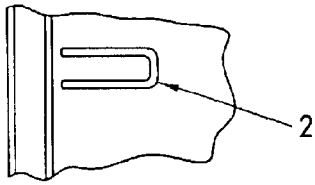
FIG. 1C (top view) are schematic diagrams of the tube assembly that is used to form loops of the tie and guide the placement of the end of the tie through the appropriate loops.
Figure 2:
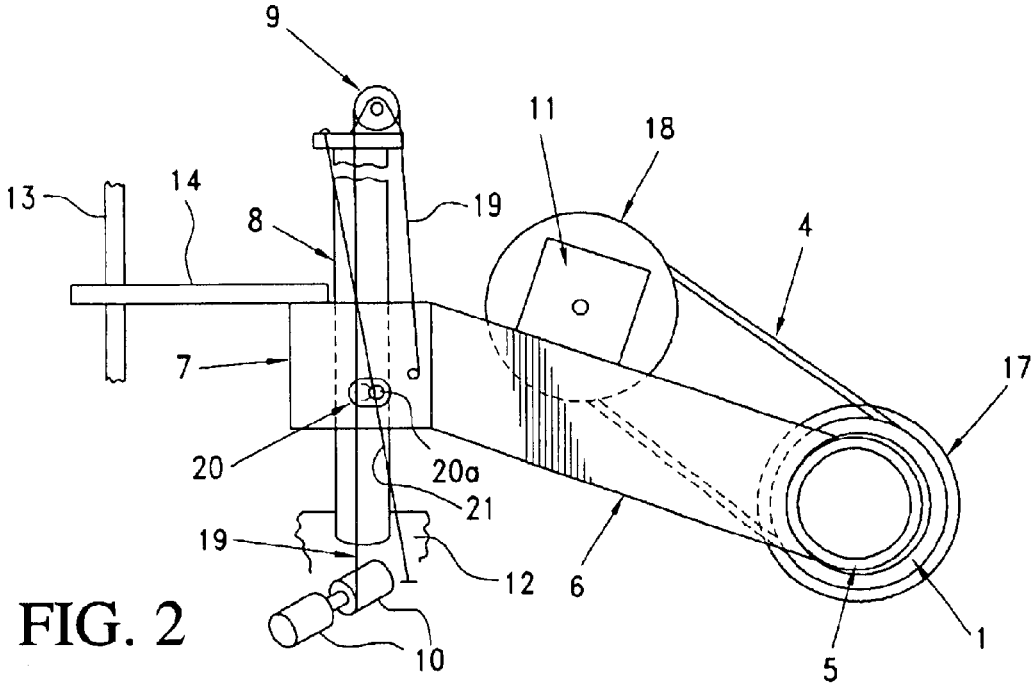
FIG. 2 is a schematic illustration (left end view) of the vertical moving assembly and the attached tube assembly.

I. Mechanisms:

(1) The tube assembly and vertically moving assembly—(FIGS. 1A–1C, FIG. 2)

The rotating tube 1 is approximately 3.5 inches in diameter, and 4 inches in length. It has a 2 inch long tab 2 attached to the periphery of its left end which is raised about ¼ inch above the surface. The tab 2 is secured at its left end, extends rightwards and is open at its right end. To the left of the tab 2, a timing belt 3 is bonded to the periphery of the rotating tube 1 and flanges 17 are provided. This bonded belt acts as a timing belt pulley wheel and engages a moving timing belt 4 that causes the rotating tube to rotate about an inner concentric support tube 5 which acts as a bearing surface. The support tube in turn is attached by a connecting bracket 6 to a vertically moving assembly 7 that, via a cable 19 and top pulley 9, is moved upwards by a winch drum and motor 10, and downwards by gravity—as allowed by the winch unwinding. The timing belt 4 is driven by a motor 11 and attached timing belt pulley 18 mounted on the connecting bracket 6. The vertically moving assembly 7 moves on a vertical post 8 fixed to a heavy baseplate 12. An additional vertical guide rod 13 combined with a slotted bracket 14 attached to the vertically moving assembly 7 prevents yaw motions of the rotating tube 1. Additionally, the inside 15 and outside 16 cylindrical surfaces of the support tube are lined with Teflon tape to reduce friction of the tie being pulled through the support tube, as well as friction between the rotating tube 1 and the support tube 5. A special provision is made to insure that the turns of cable 19 on the winch drum 10 never overlap in order to insure vertical accuracy. This is accomplished by feeding cable 19 leading to winch drum 10 through a vertical hole in guide 20 which moves laterally (into and out of the paper in FIG. 2) on pin 20*a* as vertically moving assembly 7 is moved up and down. This lateral motion occurs because an additional cable 21 at a slight angle to the vertical is also fed through the vertical hole in guide 20

Figure 3A:
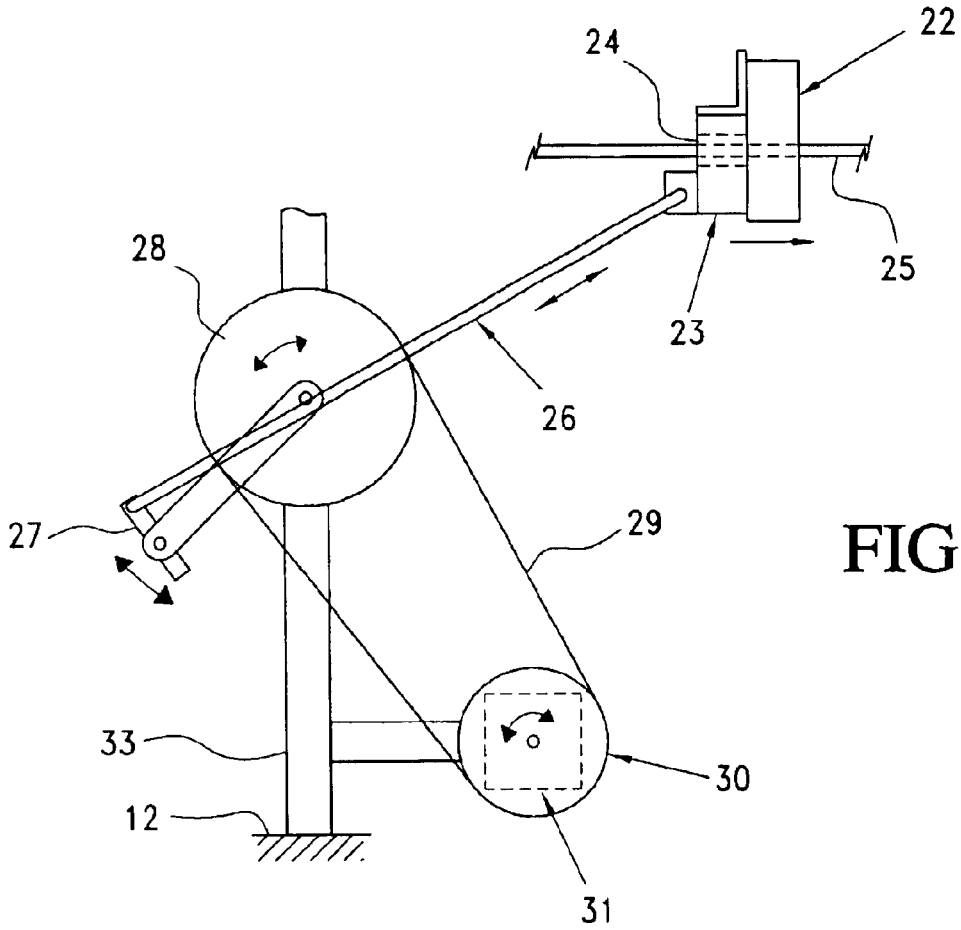
FIG. 3A (front view) and FIG. 3B (top view) are schematic diagrams of the hooker assembly and its attached crank assembly.
Figure 3B:
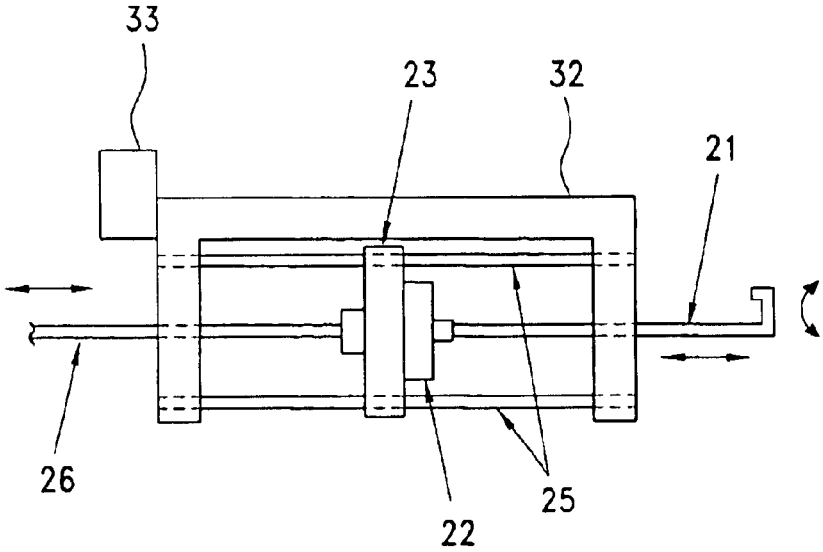

(2) The hooker assembly—(FIGS. 3A–3B)

The horizontally oriented hooker 21 is made of a coathanger wire which at its right end has 90 degree bend containing a 2 inch long section and another 90 degree bend of ¼ inch to form a modified "U" of disparate leg lengths suitable for hooking a slender object. Hooker wire 21 is attached to the shaft of a motor 22 which is mounted on a block 23 containing linear bearings 24 that allow it to translate horizontally along two guide rods 25 supported in a U shaped mounting block 32 that is attached to a vertical post 33 attached to the baseplate 12. The motor is pushed and pulled horizontally by a linkage 26 attached to the pedal 27 of a bicycle crank with integral sprocket wheel 28 which in turn is rotated by a bicycle chain 29 which is driven by sprocket wheel 30 attached to electric motor 31 also mounted on post 33. This means of producing a horizontal translation is the reverse of the usual reciprocating to rotary conversion of motion such as was done in a railroad steam engine and is used for aesthetic purposes. In reality a rack and pinion or a leadscrew arrangement would have been more efficient but less pleasing to the eye.

Figure 4A:
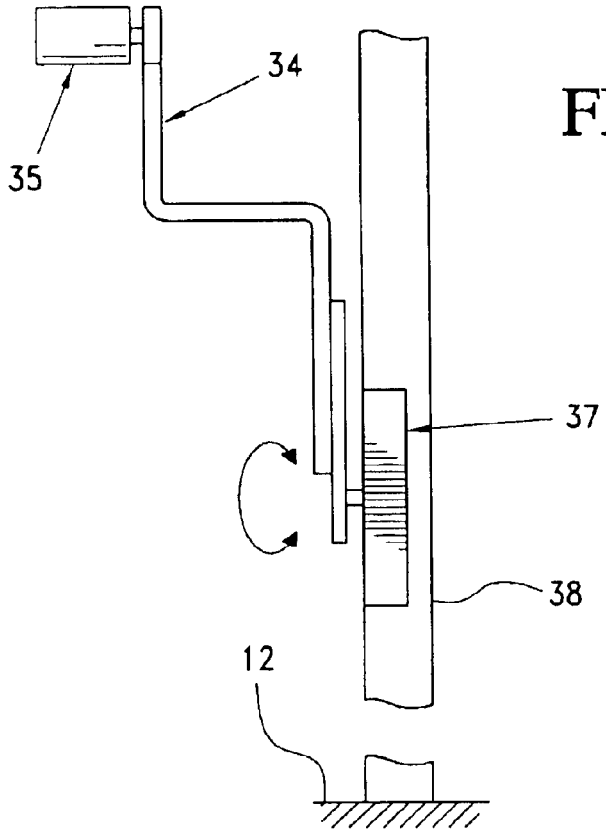
FIG. 4A (front view) and FIG. 4B (right end view) are schematic diagrams of the whirler assembly.
Figure 4B:
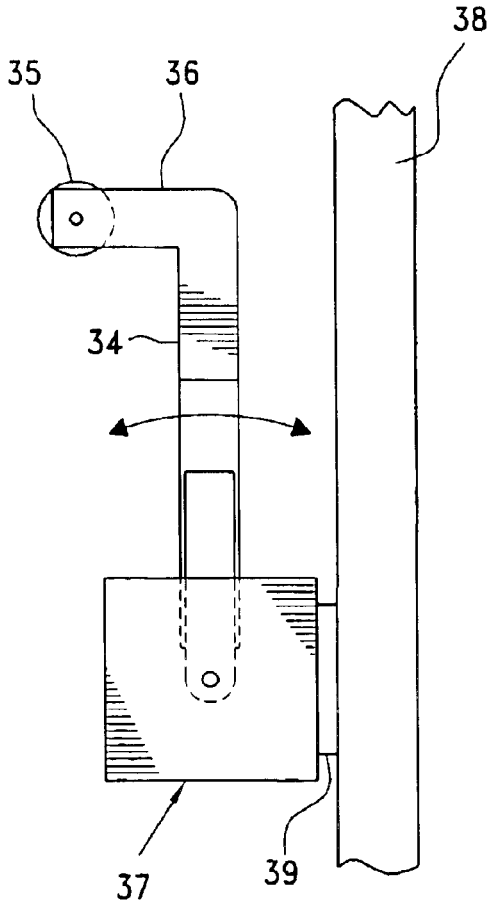

(3) The whirler assembly—(FIGS. 4A–4B)

Whirler 34 is a multiply bent plastic piece, of the shape shown in FIG. 4, which has 1 inch diameter rod 35 at its distal end to catch RT when it rapidly sweeps RT around the rotating tube 1. Rod 35 needs to be roughened to increase the friction coefficient so that the RT does not slip off during the whirling motion. Forward projection 36 of the end of whirler 34 allows it to push the RT through the Vee (see FIG. 12*c*) formed by the LT and RT hanging from the tie support assembly (see FIG. 8*b*), and let it fall forward of rotary tube 1. Whirler 34 is attached to the shaft of motor 37 mounted by bracket 39 to vertical post 38 secured to baseplate 12.

Figure 5A:
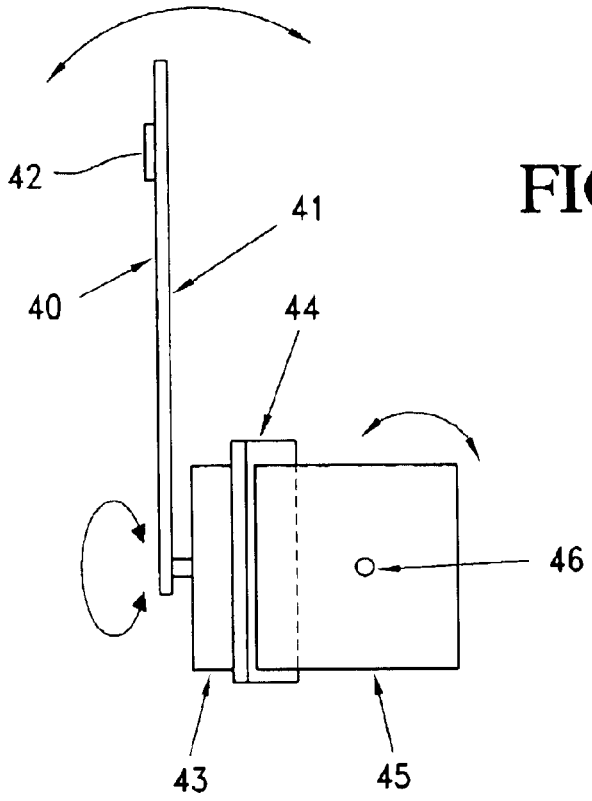
FIG. 5A (front view) and FIG. 5B (right end view) are schematic diagrams of the finger assembly.
Figure 5B:
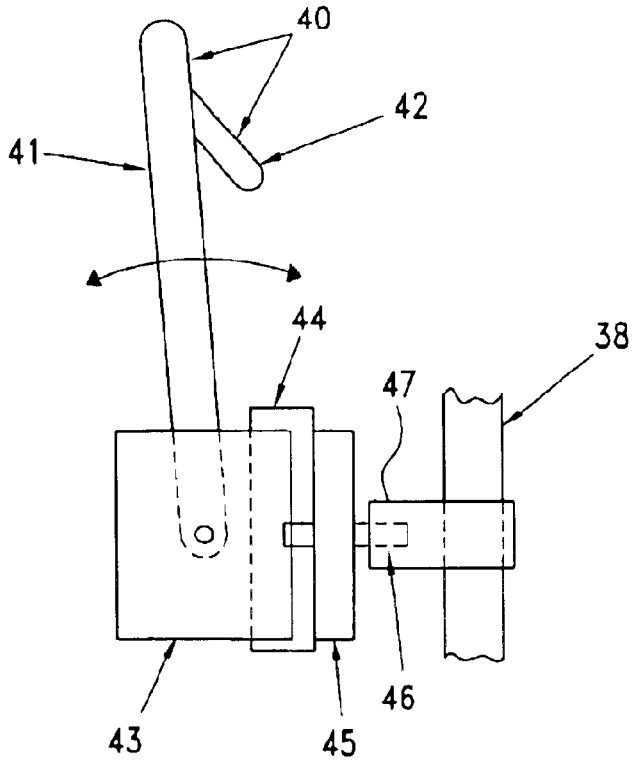

(4) The finger assembly—(FIGS. 5A–5B)

Finger 40 consists of lever 41 and oblique projection 42 coming off it several inches from its extremity. Lever 41 is attached to the shaft of a first motor 43 held by a bracket 44 attached to a second motor 45 whose shaft 46 is clamped stationary to bracket 47 mounted on vertical post 38. Shaft 46 is oriented horizontally and is perpendicular to the direction of translation of hooker wire 21. Thus when motor 45 is powered, both motors 43 and 45 rotate in roll which alters the plane of motion of lever 40. When motor 43 is powered, lever 40 rotates so that it moves towards the front or rear surface of the rotating tube 1.

Figure 6A:
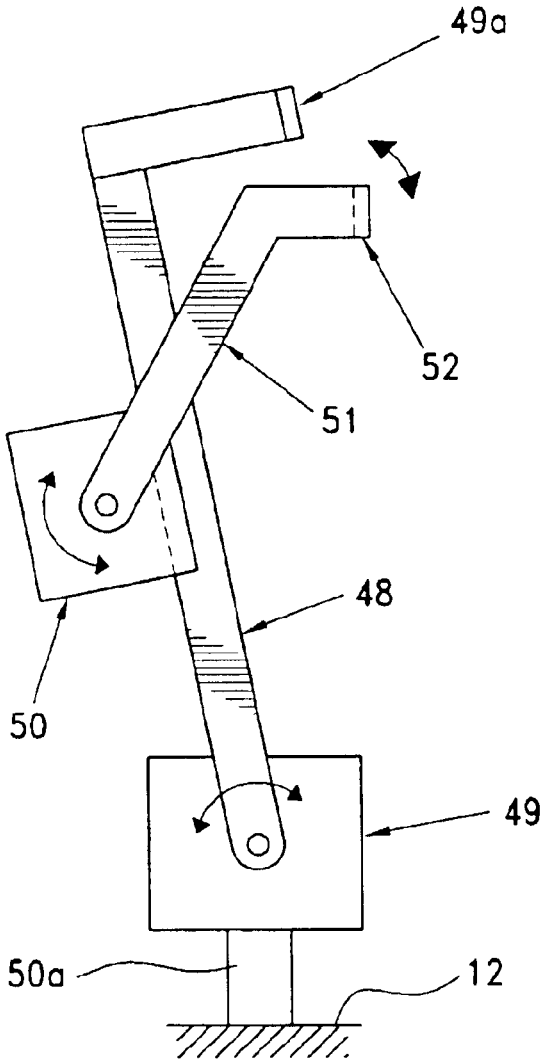
FIG. 6A (front view) and FIG. 6B (top view) are schematic diagrams of the grabber assembly.
Figure 6B:
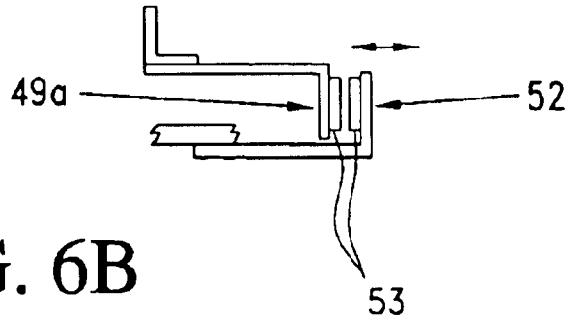

(5) The grabber assembly—(FIGS. 6A–6B)

The grabber contains lever 48 attached to motor 49 whose rotation changes the elevation angle of lever 48. The extremity of lever 48 contains an anvil bracket 49*a*. Attached partway up lever 48 is a second electric motor 50, with its axis parallel to that of motor 49, which rotates bar 51 whose extremity has an attached grabber jaw fixture 52 that mates with and pushes against anvil 49*a* to form a clamp. Both clamping surfaces of 52 and 49*a* are lined with a high friction material 53 (e.g. urethane class ML6 high friction material, Meridian Laboratory, Middleton, Wis.) to facilitate clamping the LT or RT even if only a small portion is engaged. Elevation motor 49 is mounted on bracket 50*a* secured to baseplate 12.

Figure 7:
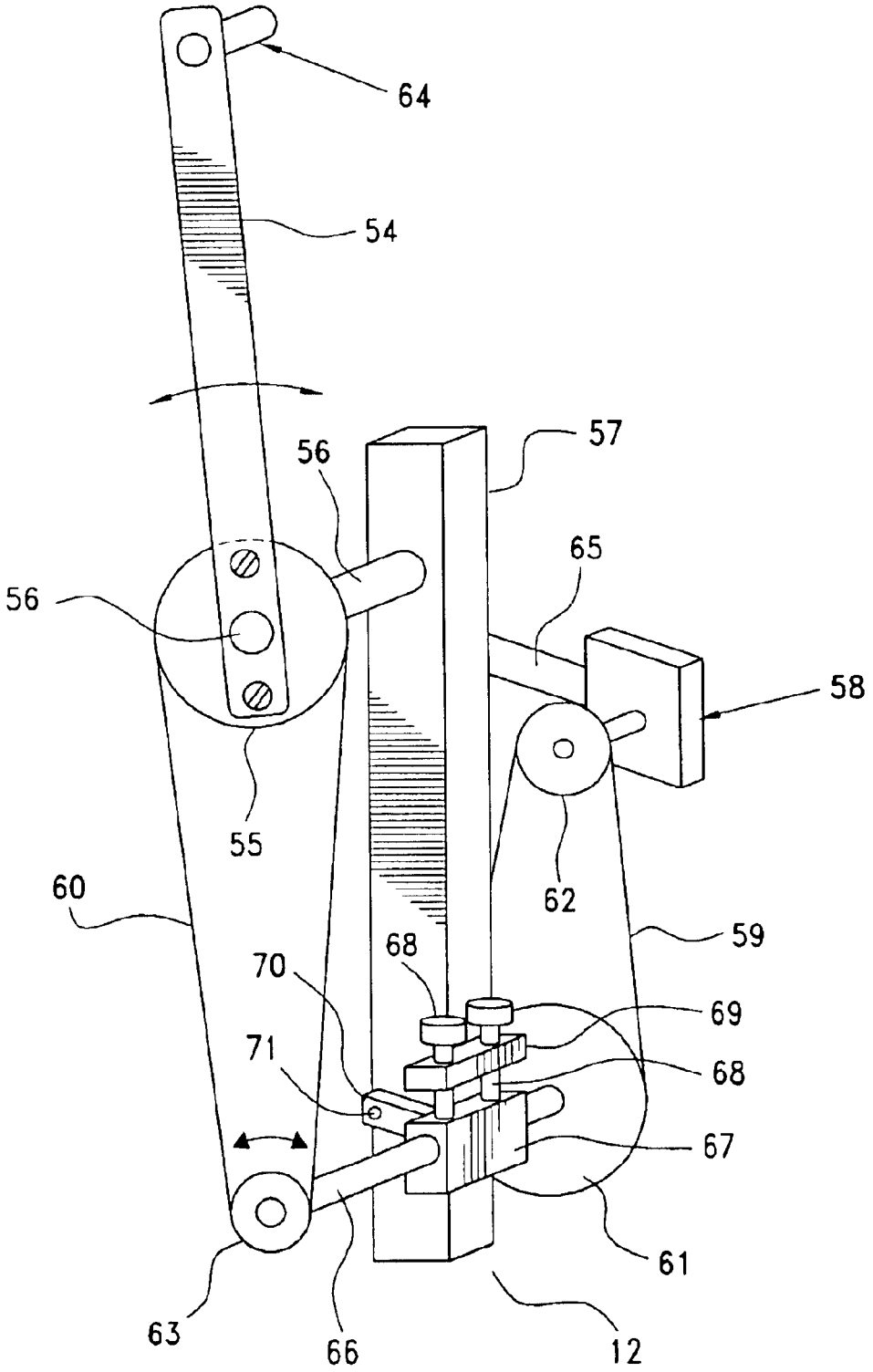
FIG. 7 is a schematic diagram (front view) of the breaker assembly.

(6) The breaker assembly—(FIG. 7)

The breaker consists of sturdy lever 54 attached to timing belt pulley wheel 55 which rotates on shaft 56 mounted in vertical post 57 attached to baseplate 12. Pulley wheel 55 is rotated by electric motor 58 via several timing belts 59, 60 and pulleys 61, 62, 63, arranged to provide a mechanical advantage. The distal end of lever 54 contains short rod 64 at right angles to lever 54 which engages the main loop of the completed tie, where the neck would normally be, when Lever 54 is rotated about shaft 56. Electric motor 58 is mounted on vertical post 57 by bracket 65. The shaft 66 upon which are mounted pulley wheels 61 and 63 is supported by a bearing block 67 which is contacted by two tension screws 68. The tension screws 68 are mounted in a block 69 fastened to post 57 at a position such that the two belts 59, and 60 can be tightened to the desired tension when the tension screws 68 are advanced against the bearing block 67. Bearing block 67 is supported by a swinging bracket 70 that is hinged to vertical post 57 by a pin 71.

(7) The tie support—(FIGS. 8A–8B)

Near the middle of its length, a portion of the tie 77 is secured to a horizontal support piece 72 attached to vertical post 38. This portion 77 is clamped in place between horizontal support 72 and front bar 73 so that the RT and LT hang straight down. The supported ends of the RT and LT are laterally positioned and separated by means of bottom guides 74 and top guides 75, to locate RT and LT relative to the whirler, finger and hooker assemblies. Hinge pin 76 allows front bar 73 to be swung away from horizontal support piece 72 when locking knob 76 is unscrewed. This provides for initially loading and removing the tie 77 before or after the tying cycle, and, if desired, for removing the tie 77 at any time during the cycle (if the machine is stopped) e.g. when the knot is complete so it can be put on someone without disrupting the tied knot. Top guides 75 are rounded to avoid damaging tie 77 in the vicinity of where it is clamped.

Figure 9:
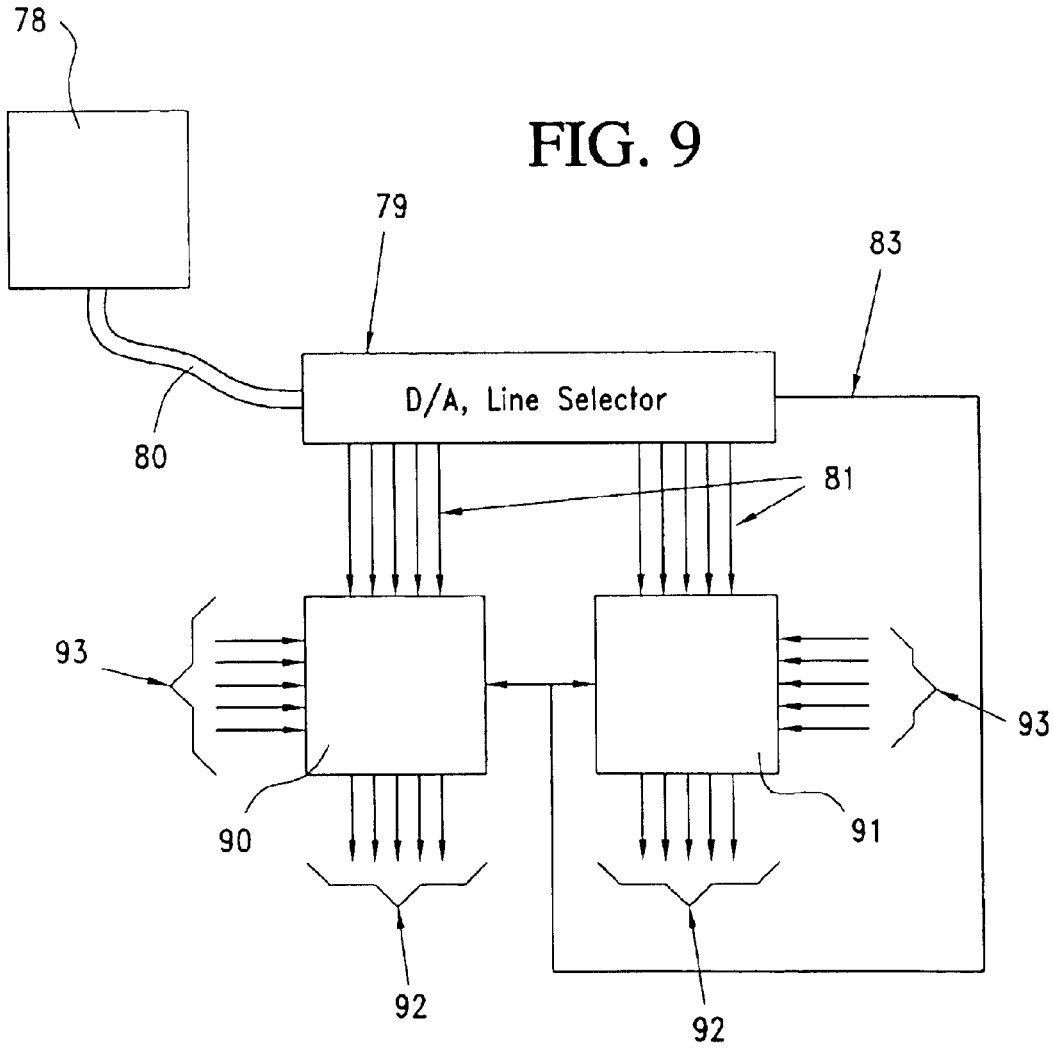
FIG. 9 is an overall signal flow diagram of the electronic controls.
Figure 10:
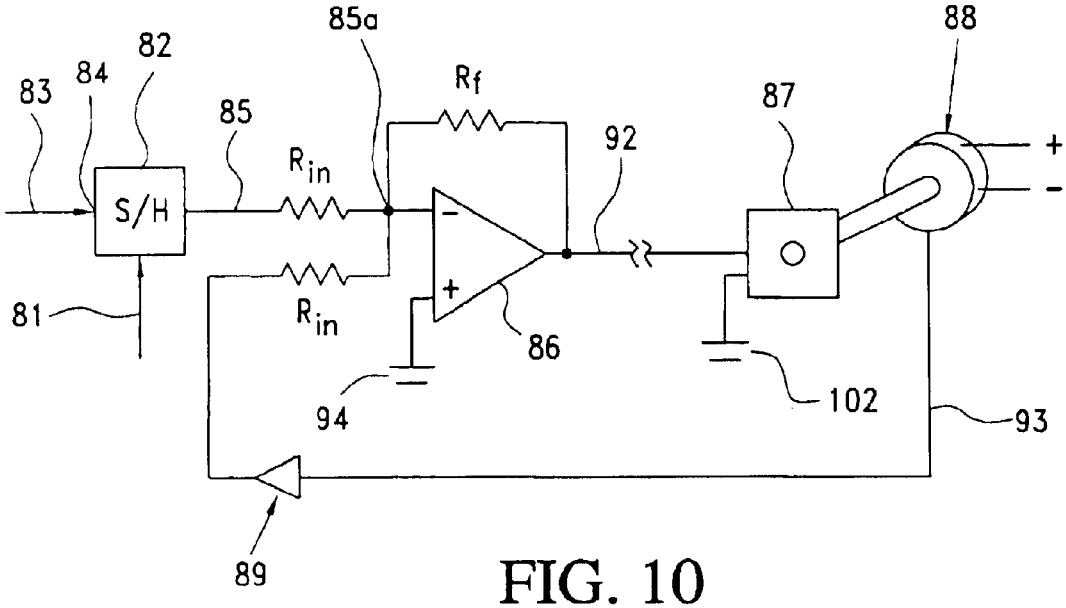
FIG. 10 is a schematic diagram of a single one of the 10 identical circuits that controls a motor.

(8) The electronic circuitry—(FIGS. 9–10)

Data from personal computer 78 comes into interface board 79 via printer port cable 80. Two digital numbers are transmitted: the motor number and how far that motor should rotate. The motor number is converted into a logic enable signal on one of 10 lines 81, each leading to a different sample and hold (S/H) module 82. The second digital number is converted by a digital to analog converter into an analog voltage command 83 that is connected to the analog input terminal 84 of all 10 of S/H's 82. All of the S/H modules 82 ignore the analog input voltage 83 except for the one S/H module 82 that has been selected by the logic enable voltage 81 (that was determined by the first digital number). The output 85 of each S/H 82 is the command voltage 85 fed through a resister Rin into the input 85*a* of each separate power amplifier 86 whose output 92 in turn is connected to a different one of the 10 electric motors 87 (FIG. 10). The output 93 from each electric motor shaft potentiometer 88 is fed back through a resister Rin to the input 85*a* of amplifier 86 that drives the motor attached to that potentiometer via a buffer amplifier 89. Each power amplifier 86 has a feedback resistor Rf between its output 92 and its input 85*a* as is standard practice by electronic engineers so that at input 85*a* to each power amplifier 86 the potentiometer output is subtracted from S/H output 85 resulting in a feedback servomechanism in which a given voltage command corresponds to a given shaft angle—as is well known by feedback control engineers. To minimize extraneous voltages and grounding problems, the power return from the motors goes to a power ground, 102, which is kept separate from the ground 94 for the low level voltage signals as is customary practice.

Thus as the different pairs of numbers are sequentially read out, different S/H modules 82 are controlled which in turn makes the corresponding motors move through shaft angles that correspond to the command voltages. The computer 78 runs a program which reads out the two numbers to the printer port and then, according to a third parameter in the data set of numbers, the computer waits a prescribed amount of time before reading out the next pair of numbers. Different data sets correspond to different sequences of moves of the various actuators described above so as to tie and untie the necktie. Thus the data set is what determines how the different parts move. The 10 S/H 82 modules, 10 power amplifiers 86 and feedback connections 93 and motor output connections 92 are contained on two separate circuit boards 90, 91. These and the interface board 79 are visibly mounted to a vertical post 100 secured to the baseplate 12 in a pleasing inverted Y configuration 101.

Figure 11A:
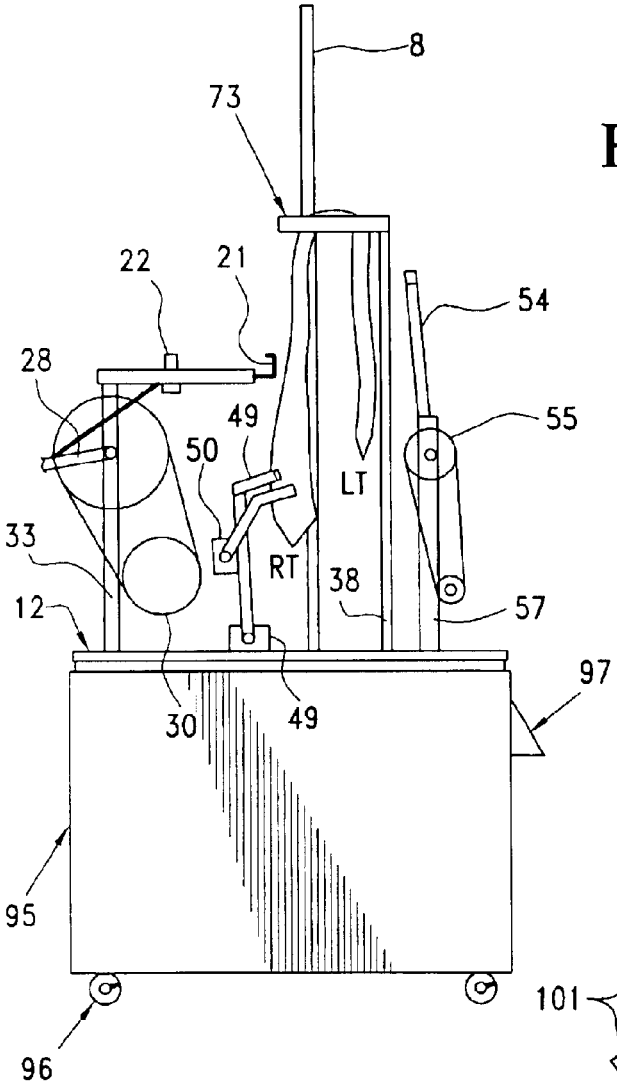
FIG. 11A is a front view of the overall layout which, for clarity, does not show the tube, vertical moving, whirler, and finger assemblies or the winch, monitor, and circuit boards.
Figure 11B:
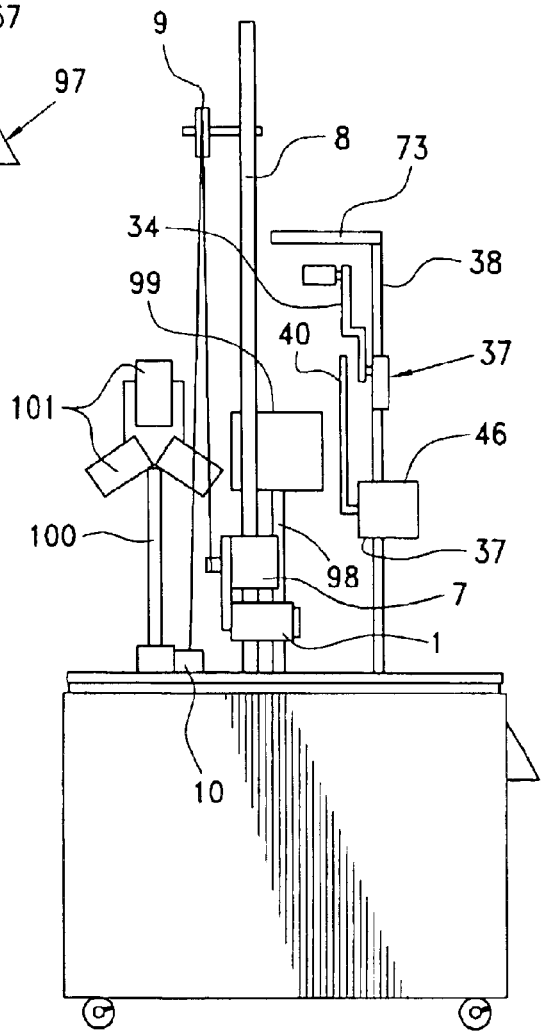
FIG. 11B, for clarity, does not show the grabber, breaker, hooker, or tie support assemblies.

(9) Overall Layout—(FIGS. 11A–11B)

Baseplate 12 is mounted on top of dull black plywood base 95 with 4 casters 96 and side shelf 97 for the computer keyboard and mouse. Computer 78 is located out of sight inside base 95. Attached to the rear of base, 95 is vertical post 98 that supports color flat panel computer monitor 99 that continually displays the command data set as the different parts move using a separate color for each different motor. The relative placement of the different actuators described in 1 thru 8 above is shown in FIG. 11.

II. Method of Operation—(FIGS. 12-A–12S)

Figure 12A:
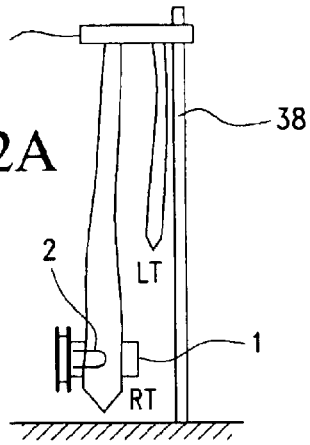
FIGS. 12A–12S are a series of schematic diagrams of the various stages of the formation of the tie knot. Some of the elements of some of the assemblies forming the knot are shown.
Figure 12B:
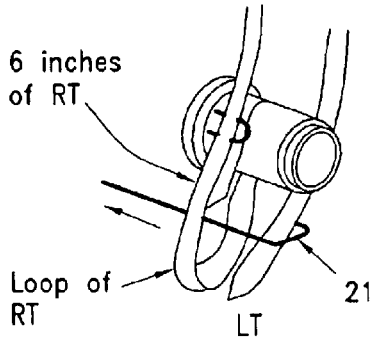
Figure 12C:
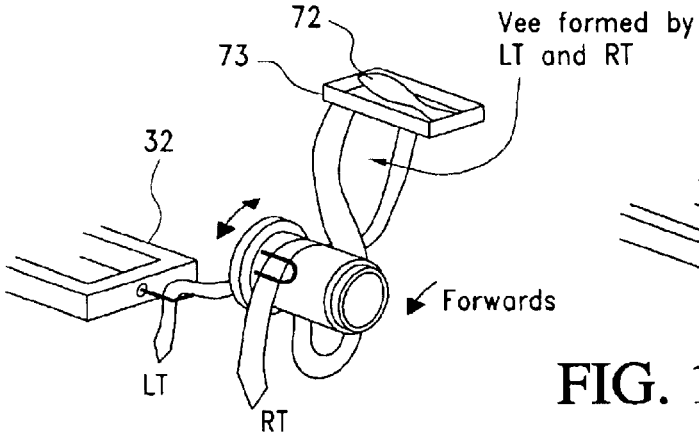
Figure 12D:
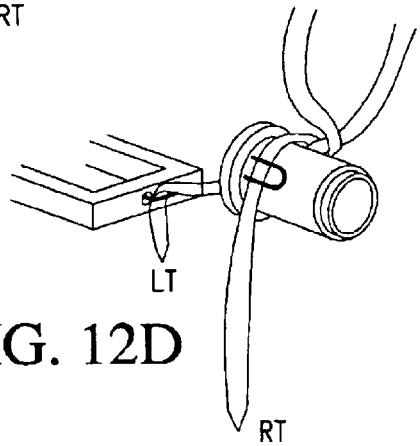

At the beginning of the cycle, both RT and LT hang straight down from tie support 72,73, and rotary tube 1 is at the lower end of its travel—6 inches above the end of RT. The first part of the cycle uses finger 40 to manipulate the end of the RT so that it is caught in tab 2, no matter how it might previously have been hanging (e.g. at startup) (FIG. 12*a*). Rotary tube 1 is then raised until it is about ¾ of the way up to tie support 72,73. Rotary tube 1 is also rotated part of a turn, and because RT is captured in tab 2, 6 inches above its end, the 6 inch free end of the RT hangs down from one side of tab 2 while on the other side of tab 2 RT is partially wrapped around rotary tube 1 creating a loop of RT hanging down from rotary tube 1 (FIG. 12*b*). With the prior assistance of finger 40, the LT is drawn through this loop of RT (FIGS. 12*b,c*) by hooker 21. The front of the loop is next moved to the rear of rotary tube 1 by finger 40 so that a very loose first wrap of RT around LT is created which is located outside of and behind rotary tube 1 (FIG. 12*c*). This creates a Vee space between the RT and LT where they hang down from Tie Support 72,73. By a series of back and forth rotations of rotary tube 1, the slack of the first wrap is removed so that RT is wrapped tightly around LT (FIG. 12*d*). This slack removal, which is crucial, results from the interaction of the friction characteristics of the tie and rotary tube 1 and its tab 2 with the weight of the hanging tie suspended from rotary tube 1. When the tube 1 with tab 2 rotates in the forward direction it drags the tie with it, but when it rotates in the reverse direction there is slippage between the RT and rotary tube 1 which takes up the slack.

Figure 12E:
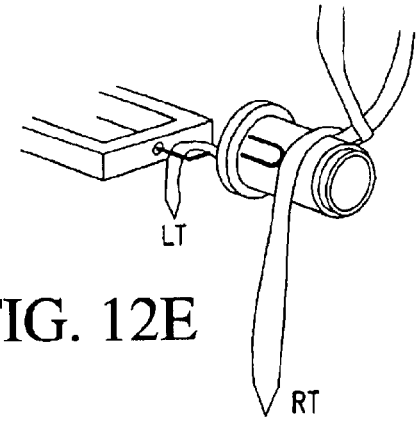
Figure 12F:
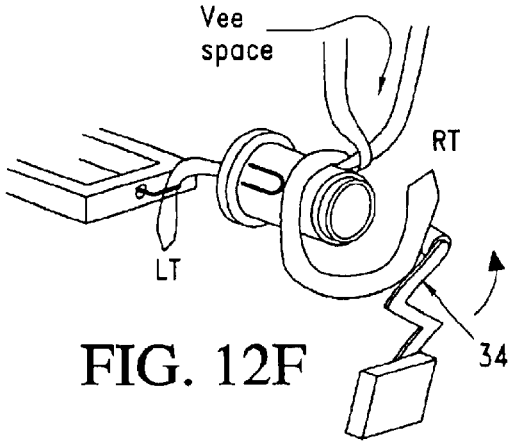
Figure 12G:
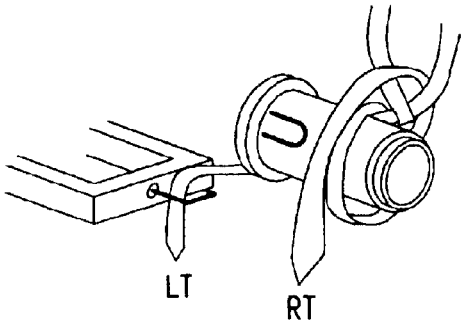
Figure 12H:
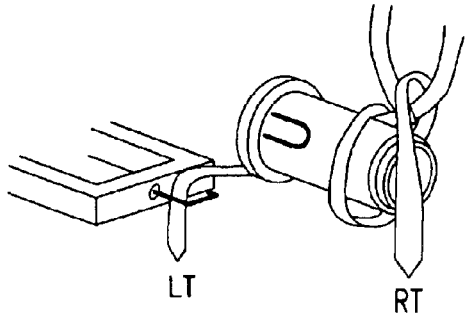
Figure 12I:
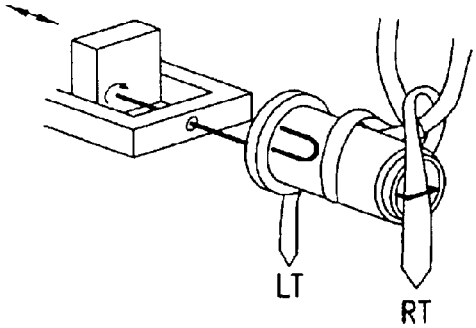
Figure 12J:
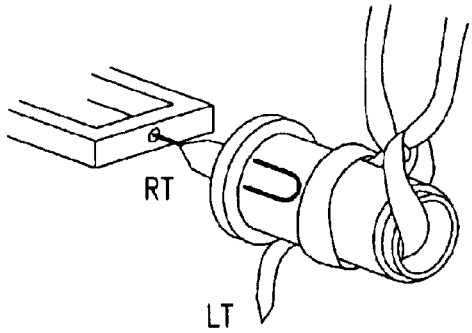

Next, using finger 40, the free hanging end of RT is manipulated laterally along rotary tube 1 to a position centered under the Vee space (FIG. 12*e*). Then the specially shaped whirler 34, 35 rotates about its horizontal axis to intercept the hanging RT and carry it around rotary tube 1 and thru the Vee space (FIGS. 12*f,g*). This is equivalent to manually bringing the RT up from under after the second crossover of the four-in-hand tie knot. It is the second wrap plus the end of RT hanging for 6 inches over the front of rotary tube 1. RT is now manipulated to the right end of the rotary tube 1 and its support tube 5 by finger 40 (FIG. 12*h*), and hooker 21 is moved through support tube 5, rotated about its axis in order to intercept the length of RT about 6 inches from its end (FIG. 12*i*), and, finally, hooker 21 pulls RT through support tube 5 (FIG. 12*j*). At this point topologically speaking, the knot has been formed.

Figure 12K:
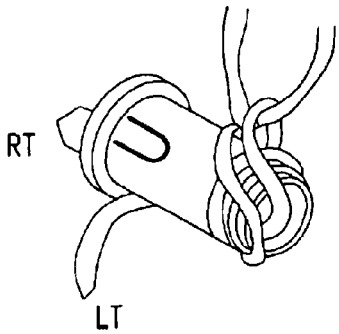
Figure 12L:
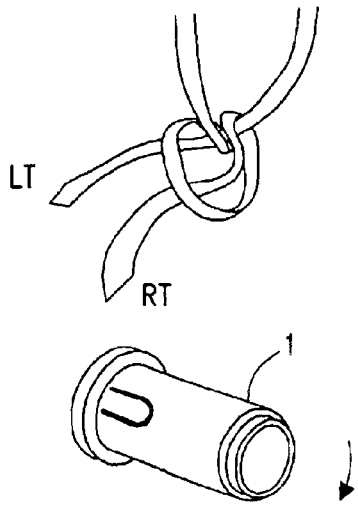
Figure 12M:
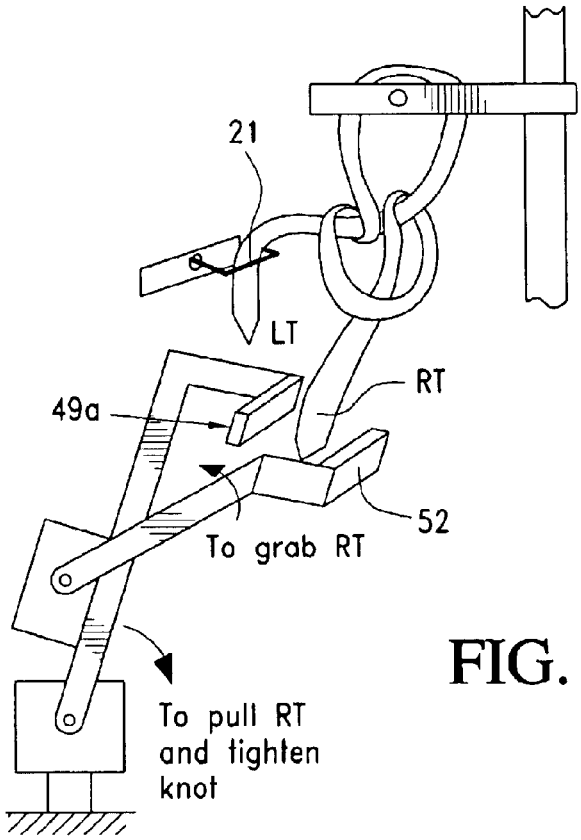
Figure 12N:
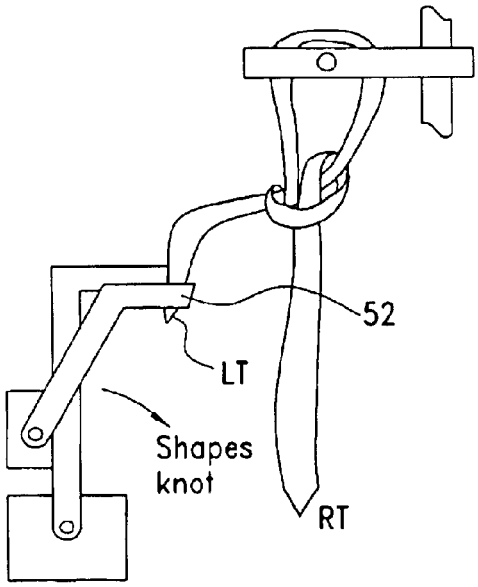
Figure 12O:
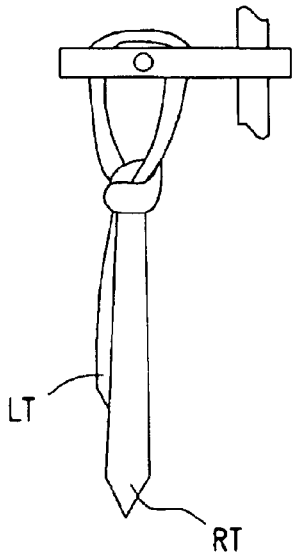
Figure 12P:
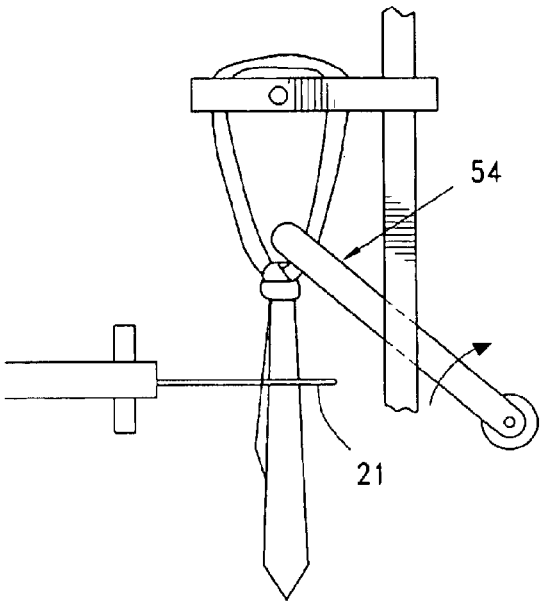
Figure 12Q:
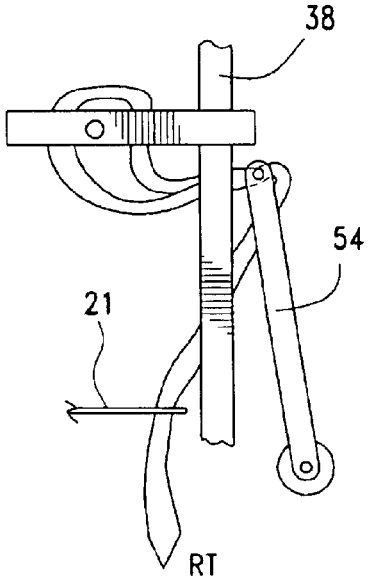
Figure 12R:
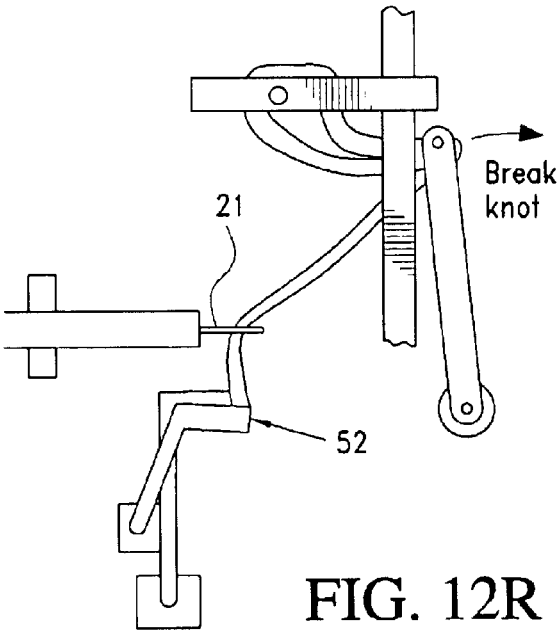
Figure 12S:
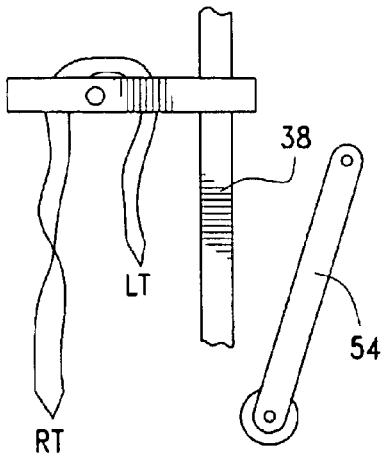

The next process is to scrape the second wrap off of the rotating tube 1 using finger 40, and hooker 21 in a pushing rather than pulling mode (FIG. 12*k*). Rotary tube 1 is then lowered out of the way and the loosely configured knot hangs free with the ends of the LT and RT protruding from the loops of the knot (FIG. 121). The LT is then secured by hooker 21 in order to position the hanging end of the RT in a favorable location so that the RT can be grabbed by grabber jaws 49*a*, 52 and sequentially pulled in a series of moves to tighten the knot (FIG. 12*m*). After each pull RT is released by grabber jaws 49*a*, 52 and repositioned so that the they can subsequently clamp RT closer to the knot and then RT is pulled again. After multiple pulls (e.g. four) the RT is then released and the LT is secured by grabber jaws 49*a*, 52 (FIG. 12*n*) and pulled tight to shape the knot so that it looks as if it had been tied by a human (FIG. 12*o*). The knot is then pulled apart by breaker lever 54 which is moved into the large loop where a persons neck would normally reside (FIG. 12*p*), and this loop is pulled until the LT is pulled through the knot which as a result comes apart. To facilitate this, the RT is first secured by grabber jaws 49*a*, 52 (FIG. 12*r*) with the aid of hooker 21 (FIGS. 12*p,q,r*) and held at an oblique angle which reduces the friction of the LT being pulled through the knot (FIG. 12*r*). The resulting twisted free hanging RT (FIG. 12*s*), is then swung back and forth in a variety of ways by finger 40 to remove all twists and turns so it hangs straight and it is then manipulated by finger 40 so it is caught in tab 2 on rotating tube 1, thus returning the tie to its original position (FIG. 12*a*). All the motors return to their initial positions completing the cycle.

What is claimed is:

1. A machine for automatically tying a four-in-hand necktie knot in a necktie, comprising:

a necktie support platform for hanging a necktie, said necktie having a left hand short segment and a right hand long segment, a rotatable cylinder having a tab to temporarily hold the right hand long segment, wherein the rotatable cylinder is supported by a concentric smaller support tube that is moveable in an up and down vertical motion, a hooking mechanism capable of pulling the left hand short segment through a loop of the right hand long segment hanging from the rotatable cylinder, and of pulling the right hand long segment through the concentric support tube, a finger mechanism capable of laterally moving the right hand long segment along the length of the rotatable cylinder and then pushing the right hand long segment towards the rear of the rotatable cylinder, and a whirler mechanism capable of flipping an end of the right hand long segment around the rotatable cylinder and up through a space between the right hand long segment and the left hand short segment and the necktie support.

2. A machine according to claim 1, further comprising an electronic and feedback control for operating various mechanisms in response to a sequence of voltage commands.

3. A machine according to claim 1, further comprising a grabber mechanism for holding and pulling the right hand long segment or the left hand short segment.

4. A machine according to claim 3, wherein the grabber mechanism comprises a clamping surface lined with a urethane high friction material.

5. A machine according to claim 1, further comprising a breaker assembly for pulling apart a four-in-hand necktie knot.

6. A machine for automatically tying a four-in-hand necktie knot in a necktie suspended from a platform, comprising:

a necktie support platform, a necktie, vertically hung by a middle segment from the support platform, with a protruding left hand (LT) short segment and a right hand (RT) long segment, a horizontal rotatable cylinder supported by a concentric smaller support tube which is attached to means to provide vertical up and down motion, said rotatable cylinder provided with means to rotate it and means to temporarily attach RT to its periphery so that with coordinated vertical motion of the support tube and rotation of the rotatable cylinder RT can either be rolled up tightly around said cylinder or loosely draped around said cylinder leaving a loop of hanging RT, a horizontally oriented hooking mechanism capable of pulling LT through a loop of RT hanging from the rotatable cylinder, and also of pulling RT through the support tube after RT has been appropriately moved to the open end of the support tube, a finger mechanism capable of laterally moving RT along the front length of the rotatable cylinder and then pushing it either to the rear of the cylinder or positioning it even with the opening of the support tube, a whirler mechanism which flips the end of the suspended RT around the rotatable cylinder and up through a space between the RT and LT and the tie support so that it lies on the front surface of said cylinder, and a grabber mechanism for holding and pulling the RT, so as to pull the end of RT after the RT has been scraped off the rotatable cylinder so as to pull the nascent four-in-hand knot tight.

7. A method for automatically tying a four-in-hand necktie knot in a necktie, comprising:

hanging a necktie on a necktie support platform by a middle segment of the necktie so that a left hand short segment and a right hand long segment hang from the support platform, temporarily attaching the right hand long segment to a periphery of a horizontal rotatable cylinder;

vertically moving and rotating the horizontal rotatable cylinder, thereby rolling the right hand long segment partially around the horizontal rotatable cylinder and creating a loop of the right hand long segment hanging from the horizontal rotatable cylinder;

pulling the left hand short segment through the loop of the right hand long segment;

laterally moving the front of the loop of the right hand long segment along the front length of the horizontal rotatable cylinder to its end and then to the rear of the horizontal rotatable cylinder, thereby creating a loose first wrap of the right hand long segment around the left hand short segment;

rotating the horizontal rotatable cylinder back and forth, thereby removing the slack of the loose first wrap so that the right hand long segment is wrapped tightly around the left hand long segment;

flipping a suspended end of the right hand long segment around the rotatable cylinder and up through a space between the right hand long segment and left hand short segment and the necktie support platform so that it lies on a front surface of the horizontal rotatable cylinder, moving the right hand long segment along the front of the cylinder to its end and then pushing the right hand long segment rearwards so it is even with the open end of the horizontal rotatable cylinder;

pulling the right hand long segment through the horizontal rotatable cylinder;

removing the right hand long segment off of the horizontal rotatable cylinder, thereby forming a nascent four-in-hand knot; and holding and pulling the right hand long segment, thereby tightening the nascent four-in-hand knot.

8. A method for automatically tying a four-in-hand necktie knot according to claim 7, further comprising holding and pulling the left hand short segment, thereby shaping the four-in-hand knot.

9. A method for automatically tying a four-in-hand necktie knot according to claim 7, further comprising pulling apart the four-in-hand necktie knot.

* * * * *